US006212922B1

(12) United States Patent
Miao

(10) Patent No.: US 6,212,922 B1
(45) Date of Patent: Apr. 10, 2001

(54) LOCK FOR ELECTRONIC EQUIPMENT

(75) Inventor: Tony Miao, Taipei Hsien (TW)

(73) Assignee: Jin Tay Industries Co., Ltd, Taipei Hsien (TW)

( * ) Notice: Subject to any disclaimer, the term of this patent is extended or adjusted under 35 U.S.C. 154(b) by 0 days.

(21) Appl. No.: 09/482,883

(22) Filed: Jan. 14, 2000

(51) Int. Cl.[7] ..... E05B 69/00
(52) U.S. Cl. ..... 70/58; 70/DIG. 57; 70/57
(58) Field of Search ..... 70/14, 18, 19, 70/30, 49, 57, 58, 229, 230, 232, 38 A, DIG. 57, 51–54

(56) References Cited

U.S. PATENT DOCUMENTS 1,921,434 * 8/1933 Stone ..... 70/230 X
3,771,338 * 11/1973 Raskin ..... 70/DIG. 57 X
4,448,049 * 5/1984 Murray ..... 70/DIG. 57 X
4,964,286 * 10/1990 Poyer ..... 70/58
5,220,815 * 6/1993 Davidge et al. ..... 70/DIG. 57 X
5,447,045 * 9/1995 Cheng ..... 70/DIG. 57 X
5,709,110 * 1/1998 Greenfield et al. ..... 70/58
5,740,685 * 4/1998 Daoud ..... 70/DIG. 57 X
5,823,021 * 10/1998 Chang ..... 70/38 A
5,875,657 * 3/1999 Kelley ..... 70/58 X
5,904,383 * 5/1999 Van Der Wal ..... 70/229 X
5,913,907 * 6/1999 Lee ..... 70/58
5,992,187 * 11/1999 Derman ..... 70/58

FOREIGN PATENT DOCUMENTS

2248650 * 4/1992 (GB) ..... 70/229

* cited by examiner

*Primary Examiner*—Suzanne Dino Barrett
(74) *Attorney, Agent, or Firm*—Bacon & Thomas, PLL

(57) ABSTRACT

A lock for locking electronic equipment such as computers and their peripheral devices, is composed of a lock assembly and a cable securely connected with the lock assembly, wherein the lock assembly includes a body with two movable retaining members provided therein, a lock core received in a back cover which is securely combined with the body, and two fastening rods respectively running through the lock assembly corresponding to two screw holes defined at opposite sides of a standard port of equipment. When the fastening rods are respectively engaged into the screw holes of the port, a user can easily lock the lock assembly with a key to remove the retaining members outwards to retain the fastening rods fixedly, whereby the lock is locked with the port.

4 Claims, 8 Drawing Sheets

LOCK FOR ELECTRONIC EQUIPMENT

BACKGROUND OF THF INVENTION

1. Field of the Invention

The present invention relates to a lock, which is detachably connected with a standard port of an electronic equipment such as computers and their peripheral devices, and locked with the port by a lock assembly provided therein to prevent the equipment from being removed by unauthorized persons.

2. Description of Related Art

Some office machines such as portable computers are very light and small, so that they are very convenient to be removed by owners, however they are also easy to be removed by an unauthorized person when an owner leaves his/her equipment temporarily.

There are some types of locks used to lock equipment, such as a portable computer if an owner leaves his/her computer temporarily. However, these types of locks normally comprise a lock assembly provided therein corresponding to a lock hole, which is defined in covers of the equipment. As different manufacturers produce different types of locks, the computer manufacturers have difficulties to standardize the lock hole that is defined in the cover of equipment they produce.

Therefore, it is an objective of the invention to provide an improved lock therein to mitigate and/or obviate the aforementioned problems.

SUMMARY OF THE INVENTION

The object of the present invention is to provide a lock comprising a lock assembly and a cable connected with the lock assembly, wherein the lock assembly is detachably connected with a standard port of equipment and locked with the port, the cable has a first end thereof securely connected with the lock assembly and a second end thereof connected with a fixed part of office furniture, whereby the equipment is easily locked to prevent the equipment from being removed by unauthorized person when an owner of the equipment leaves his/her equipment. Because the lock assembly of the invention is connected and locked with a standard port of equipment, the lock is practicable for different equipment, which has at least one vacant standard port, whereby no lock hole is needed to be prefabricated on the equipment.

Other objects, advantages and novel features of the invention will become more apparent from the following detailed description when taken in conjunction with the accompanying drawings.

The detailed features of the present invention will be apparent in the detailed description with appropriate reference to the accompanying drawings.

DETAILED DESCRIPTION OF THF PREFERRED EMBODIMENT

Figure 1:
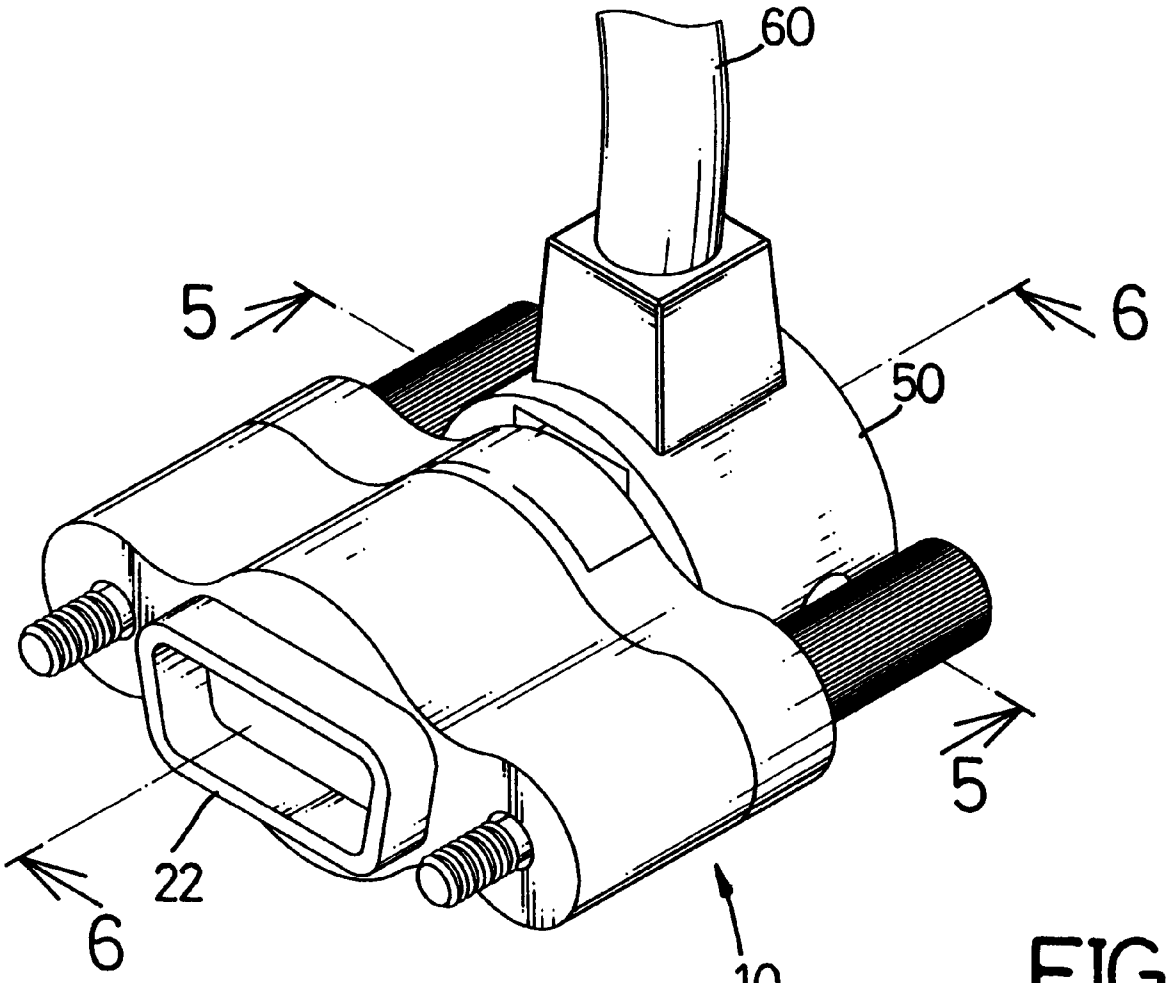
FIG. 1 is a perspective view of a lock in accordance of the present invention.
Figure 2:
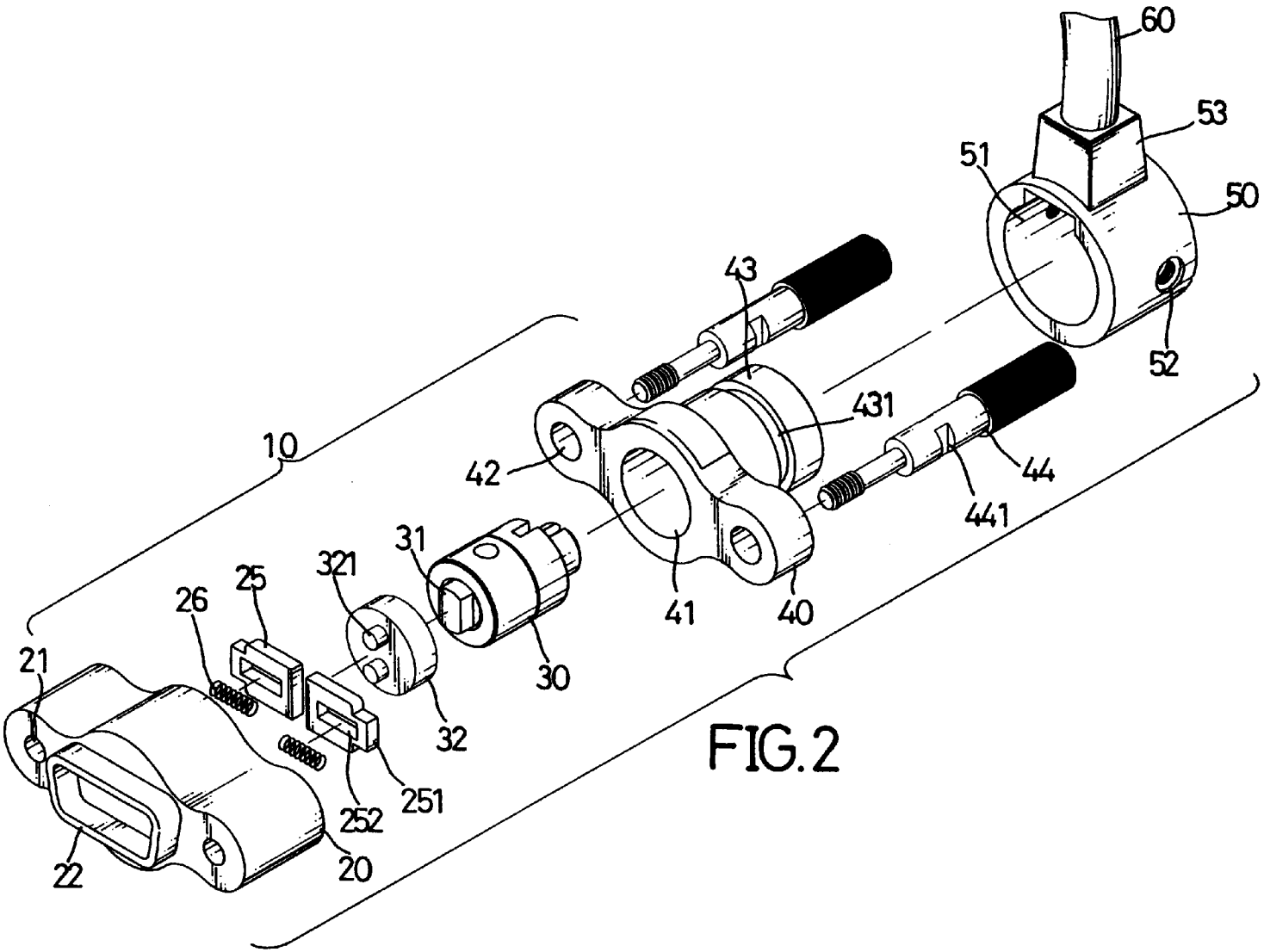
FIG. 2 is an exploded perspective view of the lock shown in FIG. 1.
Figure 3:
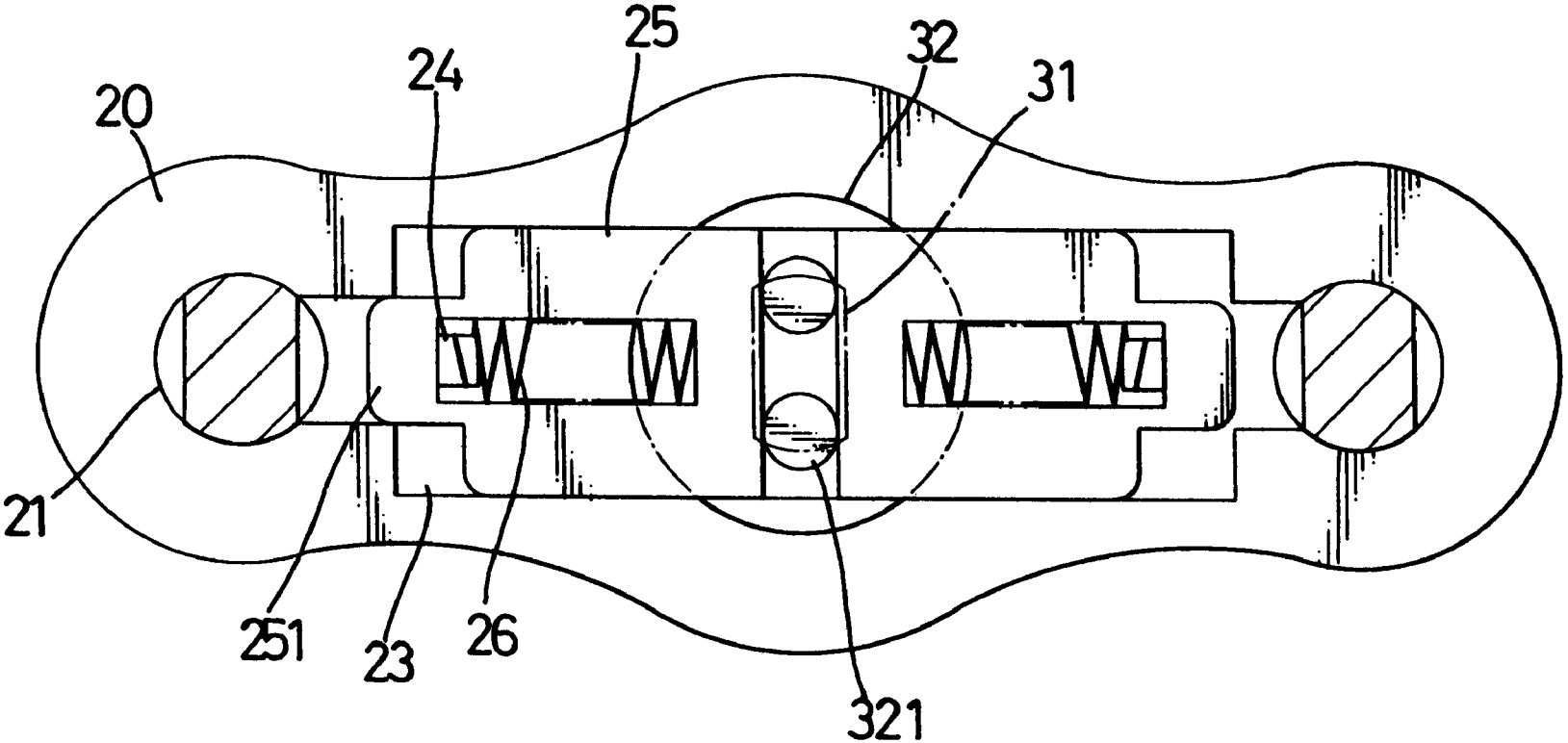
FIG. 3 is a schematic side view of the lock shown in FIG. 1, wherein the lock is in an unlocked position.

As shown in FIGS. 1, 2 and 3, the present invention relates to a lock, which is composed of a lock assembly (10) and a cable (60) connected with the lock assembly (10).

The lock assembly (10) comprises a body (20), a lock core (30) received in a back cover (40) which is securely combined with the body (20). The body (20) defines two through-holes (21) at opposite sides thereof corresponding to two screw-holes defined at opposite sides of a standard port of equipment such as a computer. A protrusion (22) is optionally formed on a front surface of the body (20) to mate with the port. A back surface of the body (20) defines a cavity (23) therein communicating with the two through-holes (21). Two stubs (24) are symmetrically formed in the cavity (23) near the through-holes (21). Two retaining members (25) are received in the cavity (23) and are movable laterally. Each retaining member (25) forms an extension (251) extending towards the through-holes (21) of the body (20) and defines a slot (252) therein to movably receive one corresponding stub (24) extended therein. Two springs (26) are respectively provided between the stubs (24) and the corresponding slots (252) to press the retaining members (25) to be closest to the lateral center of the cavity (23) as an initial unlocking position.

The lock core (30) has a key block (31) with a turning block (32) fitted thereon. When a user turns a key inserted into the lock core (30), the turning block (32) is turned over via the key block (31). The turning block (32) has a pressing block (321) formed on a front surface thereof extending into a space between the two retaining members (25). As shown in FIG. 2, the pressing block (321) is alternatively formed as two posts.

The back cover (40) includes an opening (41) defined in the center of a front surface thereof and extended towards the body (20) to receive the lock core (30) therein, and two through-holes (42) at the opposite sides thereof corresponding to the through-holes (21) of the body (20). The front surface of the back cover (40) is abutted against the back surface of the body (20). The back cover (40) further integrally forms a connecting portion (43) on a back surface thereof with an annular recess (431) defined therearound.

Two fastening rods (44) are respectively extended through the through holes (42) of the back cover (40) and corresponding through holes (21) of the body (20). Each fastening rod (44) forms a recess (441) thereon. When the fastening rods (44) are respectively engaged in the screw holes of the port, the recesses (441) thereof are substantially aligned with the cavity (23), thereby when the lock core (30) is locked with a key, the retaining members (25) are pressed by the turning block (321) to remove outwards with the extensions (251) thereof abutted against the recesses (441) of the fastening rods (44).

A connecting sleeve (50) defines an opening (51) to receive the connecting portion (43) of the back cover (40) therein. The connecting sleeve (50) further defines two pin holes (52) at opposite sides thereof and integrally forms a fixed seat (53) to securely connect with the cable (60).

As best seen in FIG. 3, when the lock assembly (10) is unlocked, the turning block (32) remains at an unlocked position such that the retaining members (25) are initially forced to be closest to the lateral center of the cavity (23) by the springs (26).

Figure 4:
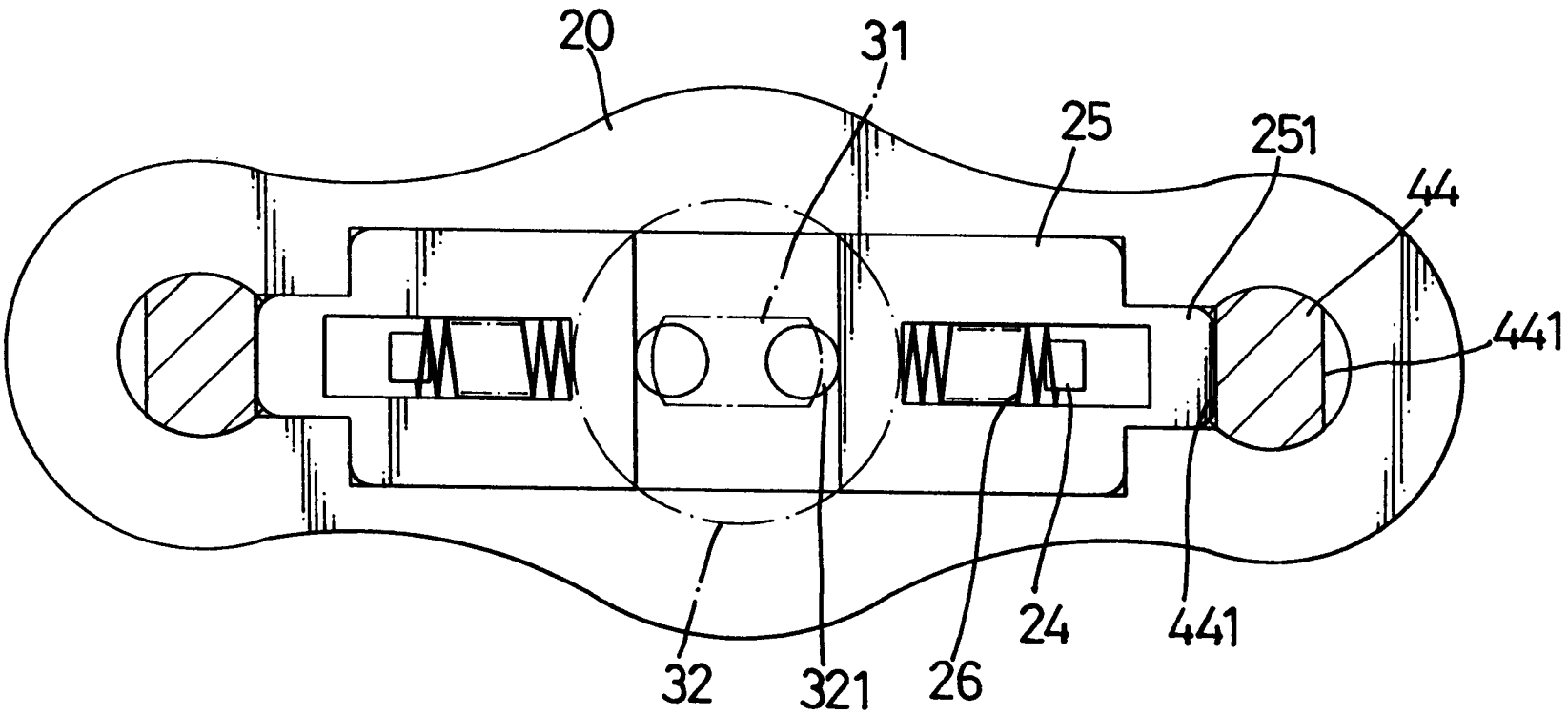
FIG. 4 is a schematic side view of the lock shown in FIG. 1, wherein the lock is in a locked position.

As seen in FIG. 4, when a user turns a key not shown inserted into the lock core (30) of the lock assembly (10), the turning block (32) is turned over via the key block (31) to a locking position whereby the pressing block (321) is turned over to remove the retaining members (25) outwards, and the extensions (251) are abutted against the recesses (441) of the fastening rods (44), thereby the fastening rods (44) are respectively retained by the retaining members (25) and the lock assembly (10) is thus locked.

Figure 5:
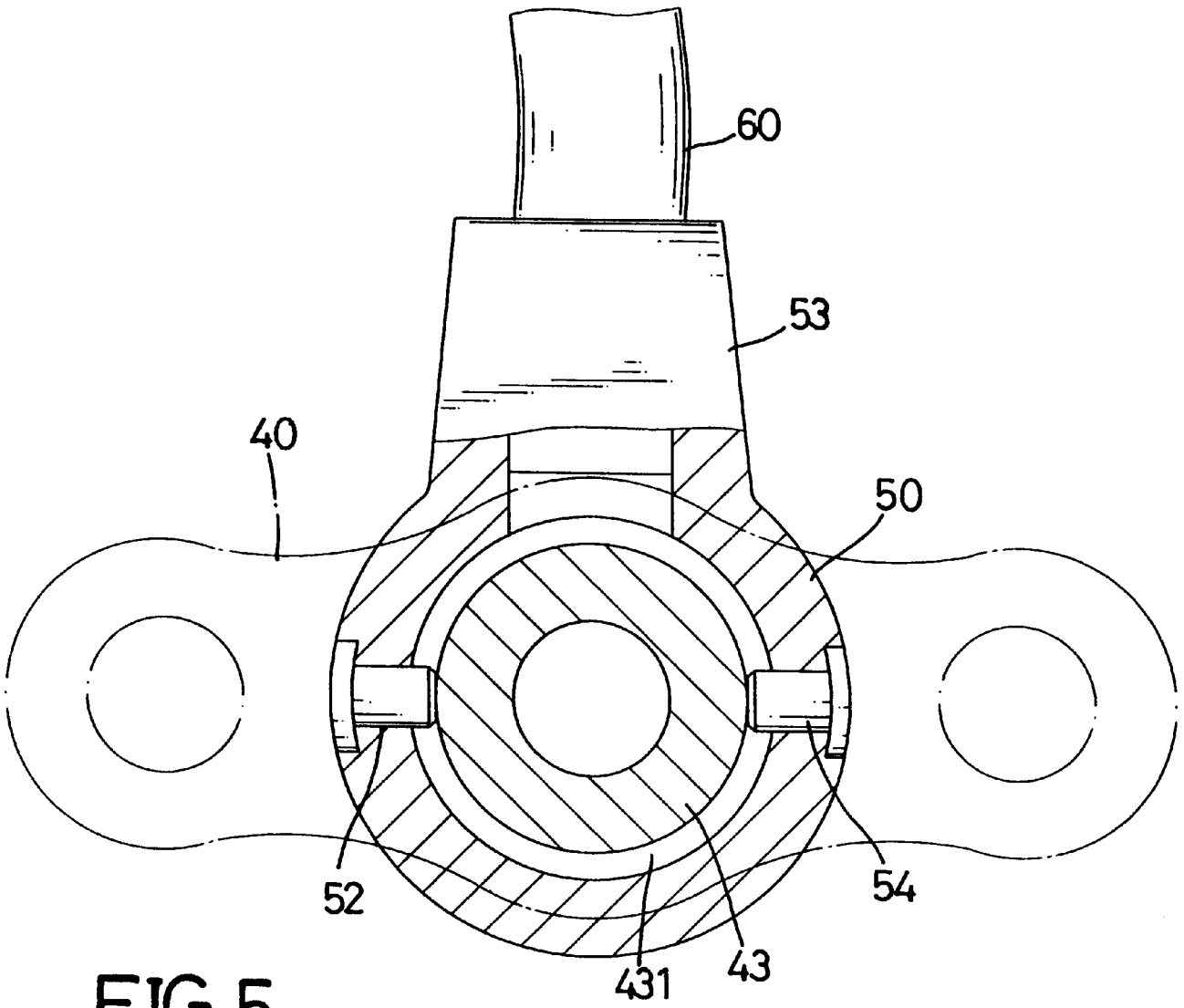
FIG. 5 is a cross sectional view of the lock in accordance of the present invention taken along a line 5—5 of FIG. 1.

FIG. 5 shows that the connecting sleeve (50) is fixed around the connecting portion (43) of the back cover (40). Two pins (54) are respectively inserted through the pin holes (52) of the connecting sleeve (50) and abutted against the annular recess (431) of the connecting portion (43), therefore the cable (60) is securely connected with the lock assembly (10).

Figure 6:
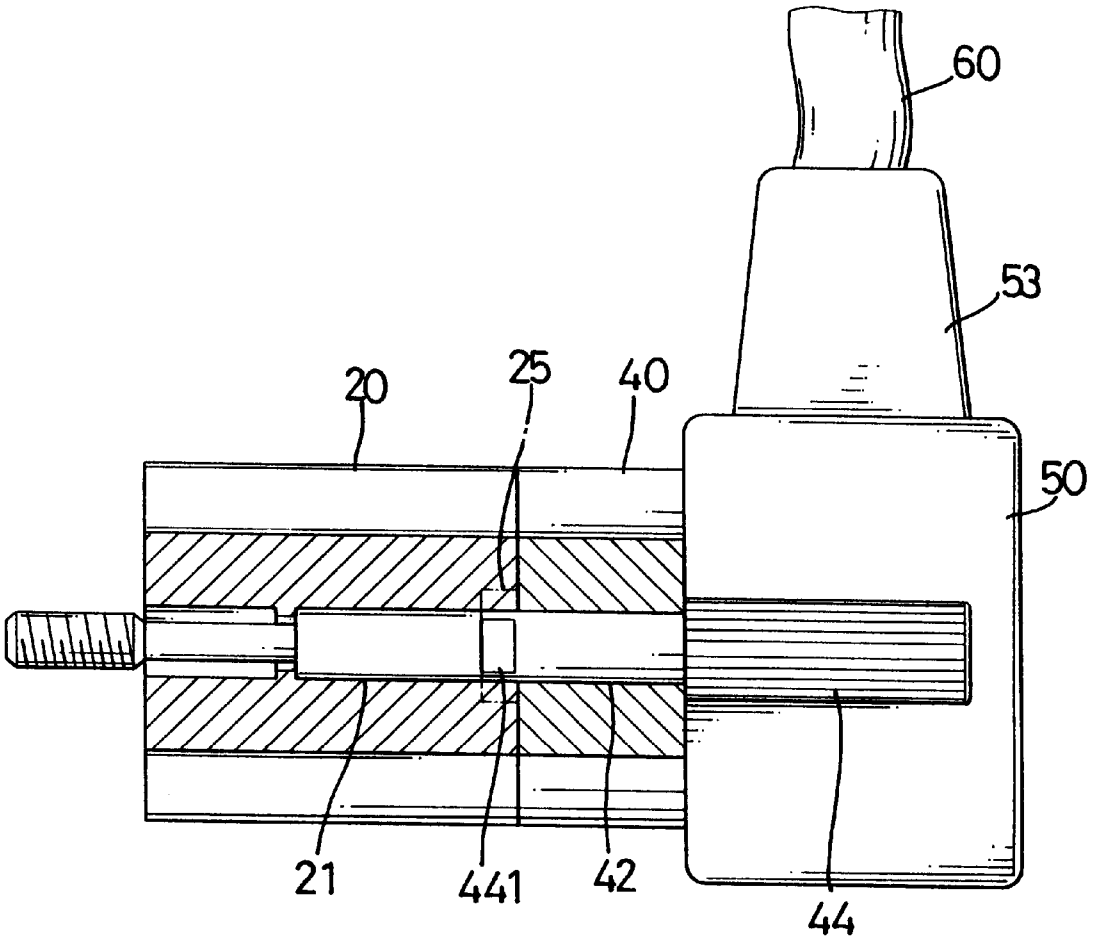
FIG. 6 is a cross sectional view of the lock in accordance of the present invention along a line 6—6 of FIG. 1.

Referring to FIG. 6, the fastening rods (44) are respectively extended through the through-holes (42) of the back cover (40) and the corresponding through-holes (21) of the body (20). The recesses (441) of the fastening rods (44) are respectively aligned with the cavity (23). If a user locks the lock assembly (10) with a key, the retaining members (25) are respectively removed outwards and the extensions (251) are respectively abutted against the recesses (441) of the fastening rods (44), whereby the fastening rods (44) are fixedly retained by the retaining members (25).

In a first embodiment, the back cover (40) is made of a plastics material and the body (20) and the back cover (40) are securely combined together by high frequency welding.

Figure 7:
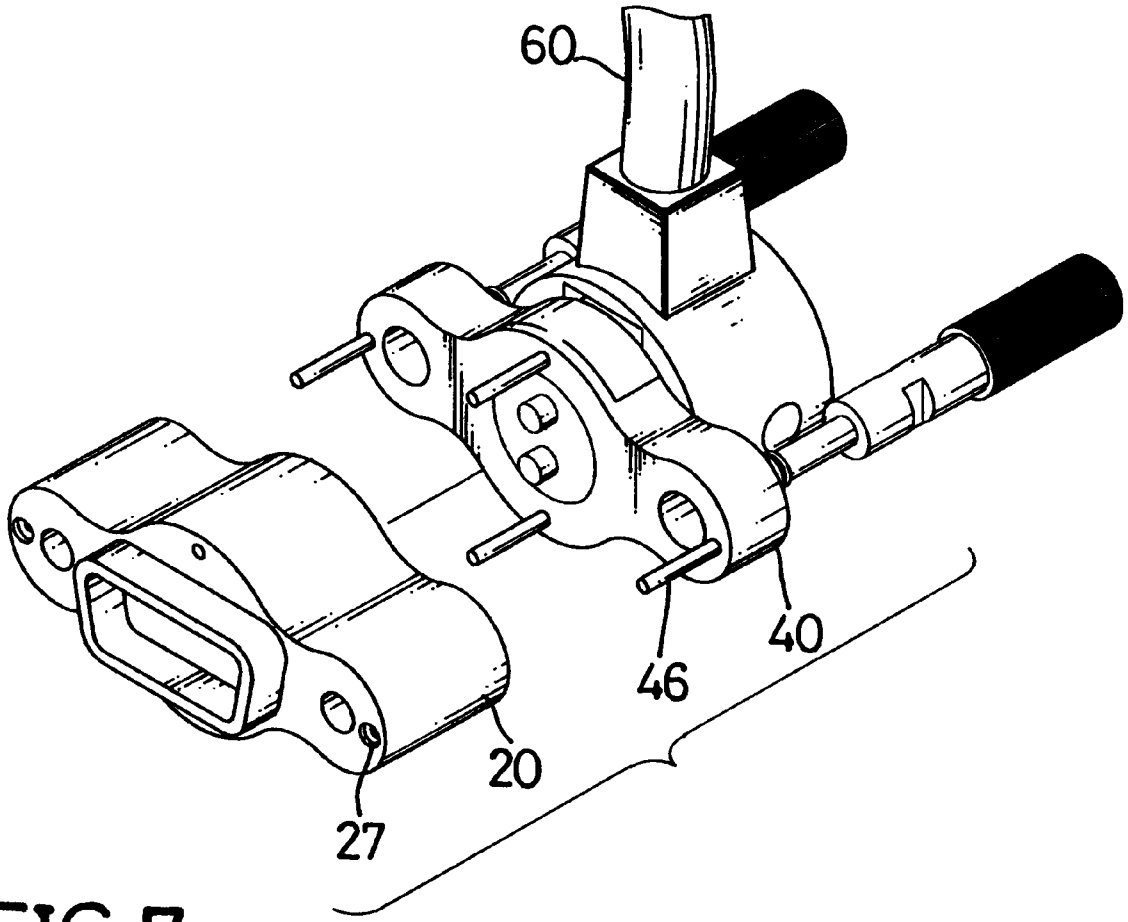
FIG. 7 is an exploded perspective view of another embodiment of the lock in accordance of the present invention.

Another preferred combination embodiment of the invention is as shown in FIG.7. A plurality of pins (46) are formed on one joint surface of two opposite joint surfaces of the body (20) and the back seat (40). In FIG. 7, the pins (46) are formed on the front surface of the back cover (40). A plurality of pin holes are defined in a counter joint surface corresponding to the pins (46). When the body (20) is abutted against the back seat (40) with the pins (46) respectively inserted through the corresponding pin holes, the pins (46) are deformed to be secured in the pin holes.

Figure 8:
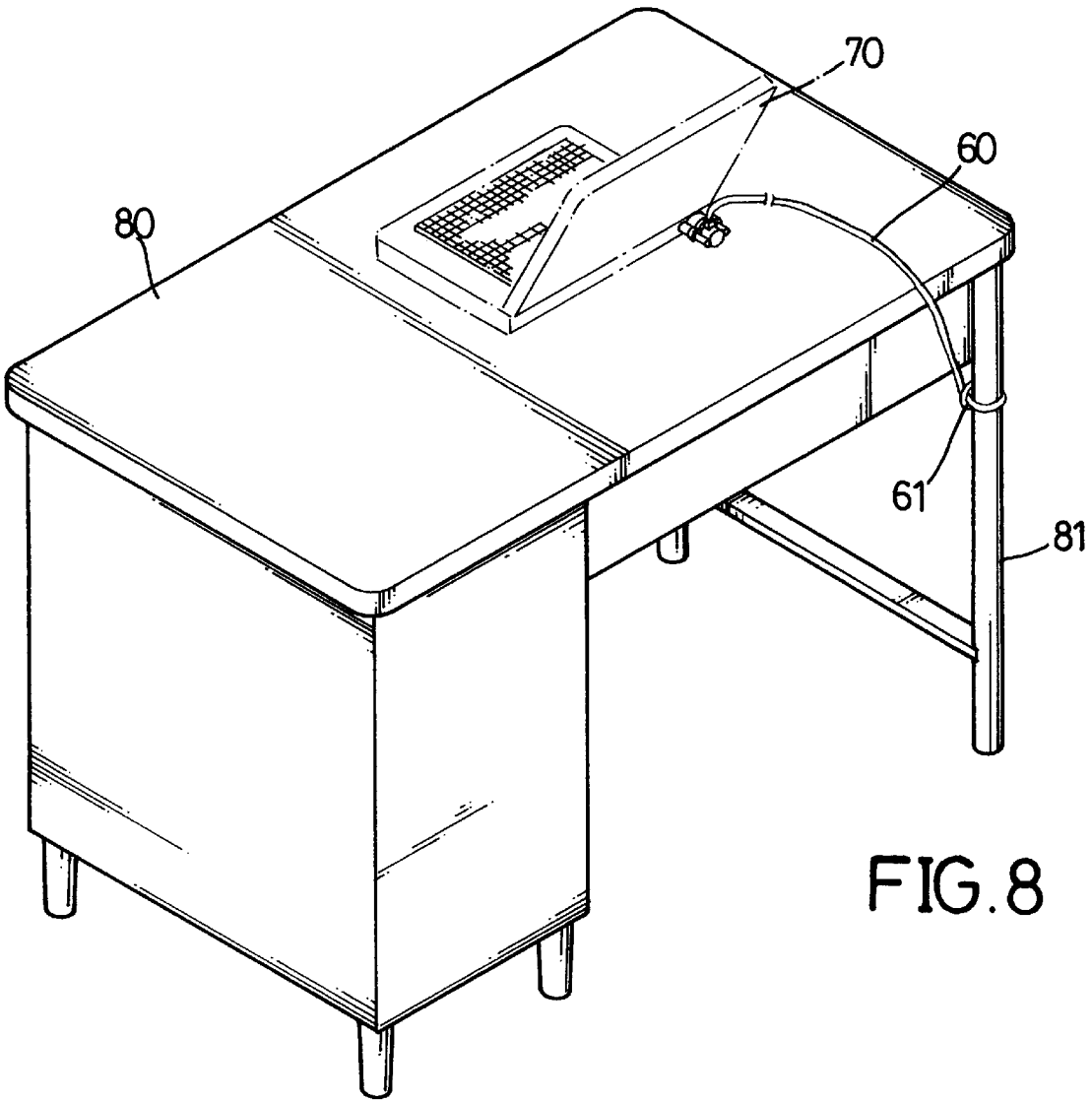
FIG. 8 is a perspective view of the lock used to lock a portable computer with an office desk.

FIG. 8 shows one use embodiment of the invention. The cable (60) has one end thereof connected with a fixed leg of an office desk and another end thereof securely connected with the lock assembly (10), which is firmly locked with a port of a portable computer.

The advantage of the present invention is that the lock is easily connected and locked with a standard port of equipment such as computers, and the manufacturers of the computers or similar equipment do not need to design a lock hole in their products corresponding to a lock assembly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lock for an electric equipment, comprising:

two fastening rods respectively extending therethrough and a cable securely extended out therefrom;

the lock comprising a body, a lock core received in a back cover thereof which is securely combined with the body;

the body comprising two through-holes defined at opposite sides thereof to respectively receive the two fastening rods therethrough, a cavity defined in a back surface thereof in communication with the two through holes, and two retaining members movably received in the cavity;

the lock core comprising a turning block provided thereon with a pressing block integrally formed on the turning block and extending into a space between the two retaining members;

the back cover defines an opening in the center of a front surface thereof towards the body to operably receive the lock core therein, and two through-holes at opposite sides thereof corresponding to the through-holes of the body to respectively receive the two fastening rods therethrough, whereby the two rods are able to lockably extend into the electric equipment;

two stubs are formed in the cavity near the through-holes of the body and extended into two slots correspondingly defined in the retaining members; and two springs are respectively provided between the two stubs and the two corresponding slots to press the retaining members to be closest to the lateral center of the cavity in an initial unlocked position.

2. The lock as claimed in claim 1, wherein the body forms a protrusion on a front surface thereof and mateable with a standard port of electronic equipment.

3. The lock as claimed in claim 1, wherein the fastening rods respectively define two recesses therein corresponding to the cavity of the body, and the retaining members respectively form two extensions extending towards the through-holes of the body to be abutted against the corresponding two recesses of the fastening rods when the lock assembly is locked.

4. The lock as claimed in claim 1, wherein the back cover forms a connecting portion on a back surface thereof with an annular recess defined therearound, a connecting sleeve is provided around the connecting portion with two pin holes defined at opposite sides thereof to receive two pins inserted therethrough and pressed against the annular recess and the cable is securely connected with the connecting sleeve.

* * * * *